United States Patent [19]

Gamberini

[11] Patent Number: 4,813,288

[45] Date of Patent: Mar. 21, 1989

[54] QUALITY CONTROL DEVICE FOR DETECTION OF THE CORRECT SHAPE OF PACKETS

[75] Inventor: Antonio Gamberini, Bologna, Italy

[73] Assignee: G.D. Societa per Azioni, Bologna, Italy

[21] Appl. No.: 7,188

[22] Filed: Jan. 27, 1987

[30] Foreign Application Priority Data

Jan. 27, 1986 [IT] Italy ..... 3319 A/86

[51] Int. Cl.[4] ..... G01N 21/90

[52] U.S. Cl. ..... 73/865.8; 250/223 R

[58] Field of Search ..... 73/865.8, 865.9, 866; 250/223 R

[56] References Cited

U.S. PATENT DOCUMENTS

| | | | |
|---|---|---|---|
| Re. 30,964 | 6/1982 | Butner et al. | 209/536 |
| 3,039,604 | 6/1962 | Bickel et al. | 73/865.9 X |
| 3,360,658 | 12/1967 | Schnermund | 250/231 R |
| 3,995,497 | 12/1976 | Negishi | 73/865.8 |
| 4,607,536 | 8/1986 | Lawson et al. | 73/866 X |

FOREIGN PATENT DOCUMENTS

| | | |
|---|---|---|
| 1545728 | 5/1979 | United Kingdom . |
| 2117519 | 10/1983 | United Kingdom . |
| 2133873 | 8/1984 | United Kingdom . |

*Primary Examiner*—Tom Noland

*Attorney, Agent, or Firm*—Cushman, Darby & Cushman

[57] ABSTRACT

The quality control device disclosed is designed to detect the correct shape of packets, especially crush type packs of cigarettes, and comprises transducers, excited by proximity of a sheet of tin foil, and photoelectric cells which check that the side folds of the wrapping are properly stuck down; both types of component are structured such as to transmit an error signal to circuits triggering operation of a knockout power source used to eject any defective packets.

15 Claims, 6 Drawing Sheets

QUALITY CONTROL DEVICE FOR DETECTION OF THE CORRECT SHAPE OF PACKETS

BACKGROUND OF THE INVENTION

The invention relates to a device for detection of the correct shape of packets.

While the specification has been drafted with direct reference to cigarette packets by way of example, no limitation in the scope of application is implied.

In cigarette packaging machinery used in the production of soft, crush type packs, the device disclosed will be positioned between the unit which forms the packet (generally a first inner wrapping of foil and a second wrapping which incorporates the printed label), and the unit by which a covering of transparent film is applied to the formed packet. It is conventional practice in cigarette manufacture to run quality control checks on finished packs, in order to enable rejection of any incomplete and/or defective items. In the great majority of instances, however, such checks must necessarily be limited to a simple verification of whether or not the wrapping sheet or sheets have been applied, by reason of the embodiment of the packaging machine's exit stage and of the position in which the checks are implemented.

Clearly enough, this is a type of quality control that lacks completeness, inasmuch as the effective presence of the wrapping or wrappings is established, whilst the shape of the packet remains undetected.

The object of the invention is to embody a quality control device capable of overcoming this drawback.

SUMMARY of the INVENTION

A device for detection of the correct shape of packets according to the invention comprises conveyor means which carry the packets through a longitudinal path in single file in such a way as to pass through means that check for the presence and/or correct position of at least one of the wrapping materials from which the packet is fashioned.

In the device disclosed, the means used to implement such a check are designed to supply an error detection signal to control circuitry that triggers the operation of means by which defective packets are ejected.

BRIEF DESCRIPTION of the DRAWINGS

The invention will now be described in detail, by way of example, with reference to the accompanying drawings, in which.

DESCRIPTION of the PREFERRED EMBODIMENT

Figure 1B:
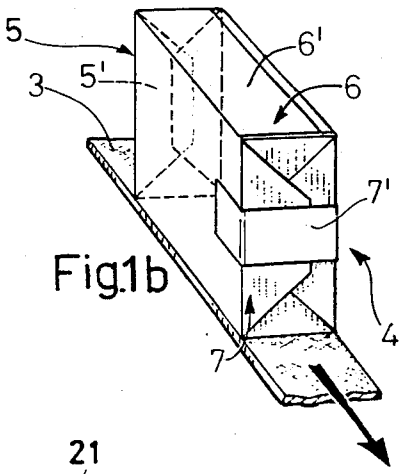
FIG. 1*b* is the perspective of a detail of FIG. 1*a*.
Figure 1A:
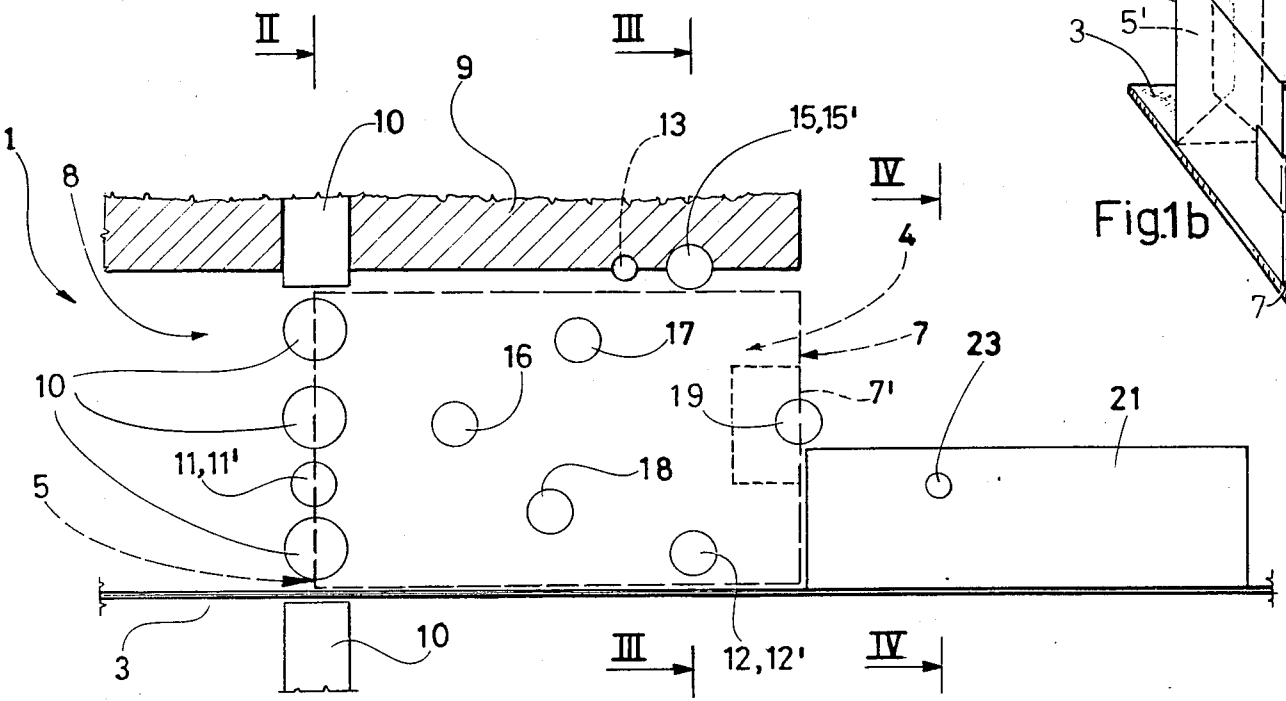
FIG. 1*a* is a schematic representation of the device disclosed, viewed in longitudinal section.

With reference first to FIGS. 1...4 of the drawings, 1 denotes a quality control device in its entirety, which comprises a bracket 2 carrying conveyor means embodied as a belt 3, along which packets 4 travel through a longitudinal path, in single file, from an upstream packaging unit to a downstream cellophane-wrapping unit; both machine units are conventional, and thus not illustrated.

In the embodiment described and illustrated herein, the packets 4 contain cigarettes, though the device might be used for any similarly packaged product. Each packet 4 exhibits a conventional inner sheet of foil, which envelops the product entirely, and an outer sheet of material, suitably decorated in print etc. and constituting the label, which is wrapped around the foil. More precisely, the label does not fully envelop the packet 4; the top 7 (or the front end, as seen in FIG. 1*b*) is left uncovered, whilst the bottom 5 (or rear end, in FIG. 1*b*) and one side 6 (located uppermost in FIG. 1*b*) are fastened with respective folds 5' and 6' that will normally be gummed and stuck down by the machine from which the packets emerge into the device 1. The top 7 of the packet is fastened with a government seal 7', folded down and stuck to the front and back of the label, such that the area remaining exposed is covered by the inner foil wrapping only.

Figure 2:
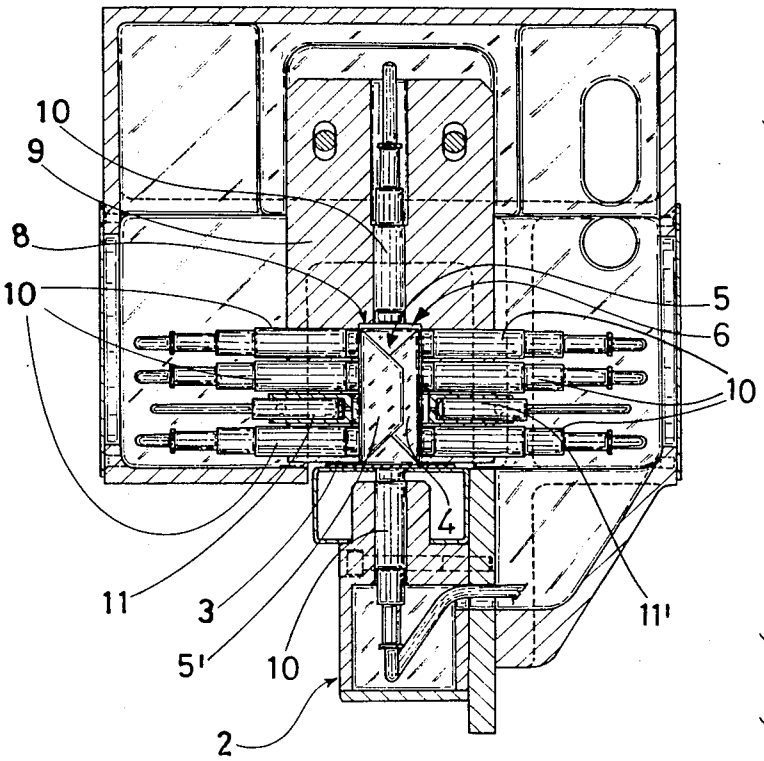
FIGS. 2, 3 and 4 show more detailed views of the device disclosed, viewed in sections taken through II—II, III—111 and IV—IV in FIG. 1*a*, respectively.
Figure 3:
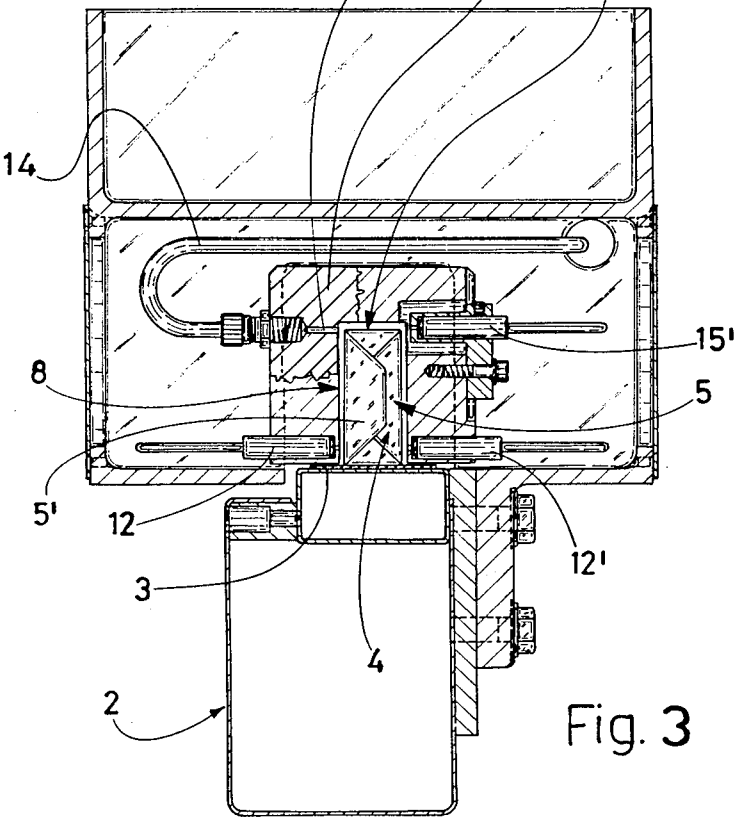

The packets 4 proceed lengthwise along the conveyor belt 3, resting on the side opposite the side 6 at which the fold 6' is located, and are taken one by one through a longitudinal tunnel 8 the dimensions of which are marginally greater than that of the single packet 4: the tunnel is formed in a block 9 and occupies an intermediate point in the device 1. It will be observed from FIG. 2 that a first area of the block 9 exhibits a plurality of transducers 10 encircling the tunnel 8 and conveyor belt 3, each of which is designed to emit a signal (logic level-1) when excited by proximity of a conductive material, in this instance, the tin foil wrapping enveloping the cigarettes: the embodiment shown has eight such transducers. 11 and 11' denote the two components of a photoelectric cell installed in the same plane as the transducers, emitter and receiver respectively, wired such that the receiver emits a logic level-1 signal whenever the beam is broken by a packet 4.

12-12' and 15-15' denote the respective emitter and receiver components of two further photoelectric cells, likewise installed at opposite sides of the block 9; these are located at points set apart from that occupied by the transducers 10, along the path of movement of the conveyor belt 4, one toward the bottom of the tunnel, and the other above the level of the upwards-directed longitudinal face 6 of the packet. The two receivers 12' and 15 likewise emit a logic level-1 signal whenever the relative beam is broken.

13 denotes a bore located in the block 9 at one side of the tunnel 8, above the level of the upward-facing side 6 of the packet 4, through which compressed air from a supply line 14 is jetted at the side fold 6' of the wrapping in such a way as to penetrate below the exposed edge.

Similarly installed in the block and at one side of the tunnel, one has further photoelectric emitter and receiver components, denoted as pairs, 16, 17, 18 and 19 in this instance, since the cells operate by reflection rather than interruption of the beam. The first three pairs are located at given positions corresponding to features of the label print, whilst the position of the fourth is set to coincide with that of the government seal 7' at the moment when the bottom 5 of the packet, the trailing end, passes through the initial beam 11-11'. The single cell 16, 17, 18 and 19 will emit a level-1 signal when its beam is reflected, i.e. when the feature detected appears correctly positioned on the packet 4.

Figure 4:
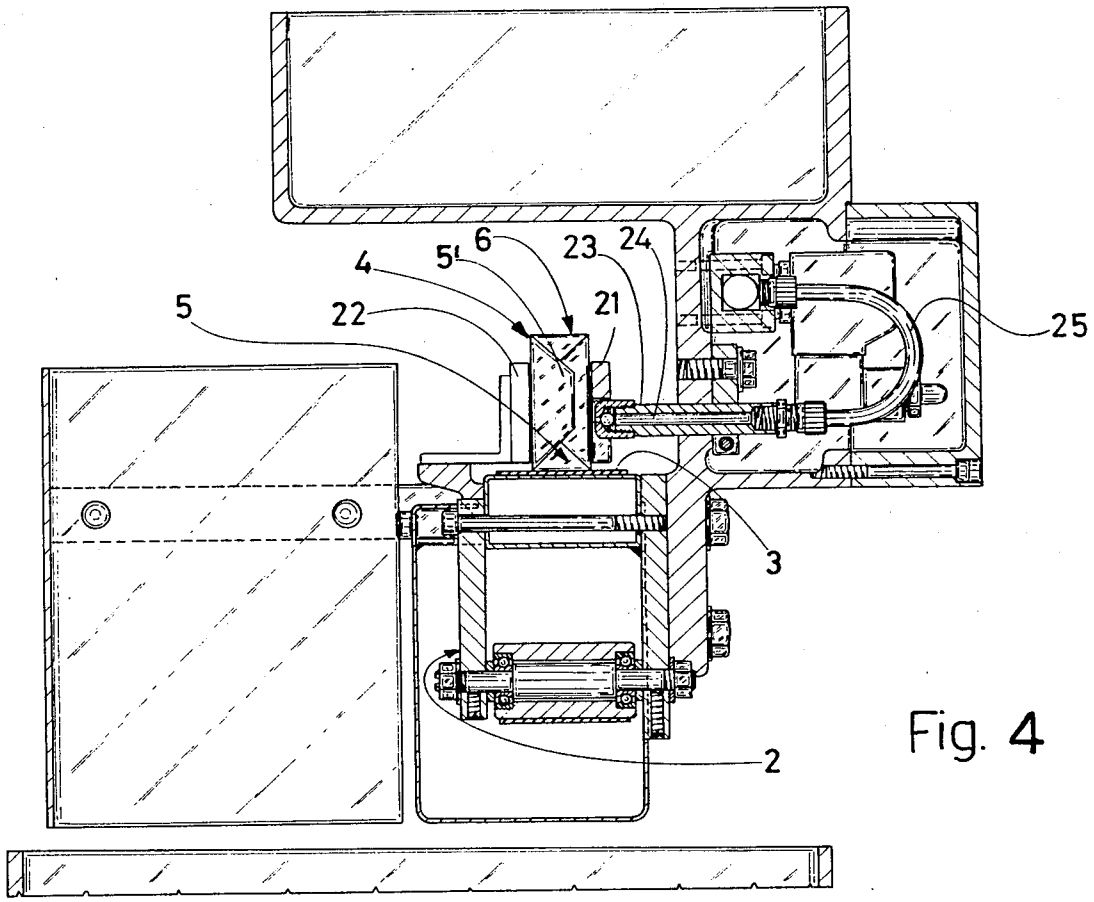

A channel is created downstream of the block 9 by two vertically-disposed fences 21 and 22 which flank the packet 4 on either side (see FIG. 4). The one fence 22 is provided with an opening large enough to admit a single packet 4, and the initial stretch of the opposite fence 21 carries a fitting 23 with an internal bore 24 through which compressed air can be directed from a supply line 25.

Figure 5:
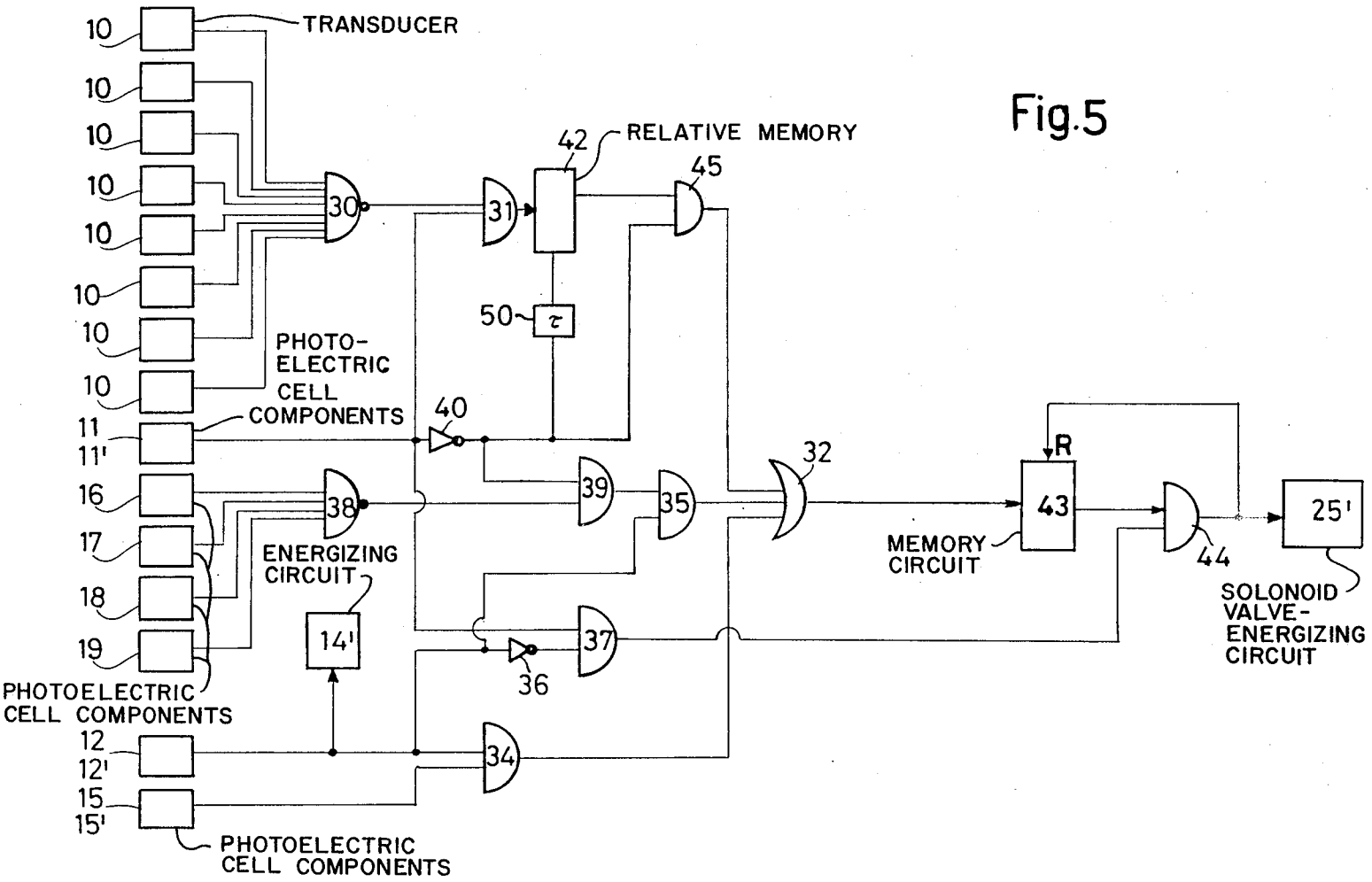
FIG. 5 is a diagram of the control circuit utilized in a device according to the invention.

Turning now to FIG. 5, the eight transducers 10 are wired to respective inputs of a NAND gate 30, the output from which is directed into one input of an AND gate 31; the remaining input of this same AND gate 31 receives the signal from the photoelectric cell denoted 11-11', and the output signal produced is fed first into a memory circuit 42, say, a flip-flop, thence to one input of a further AND gate 45, the output from which is wired to one of the three inputs of an OR gate 32.

The output signal produced by the photoelectric cell denoted 12—12' is directed, on the one hand, into an energizing circuit 14' that serves to operate a solenoid valve controlling the flow of compressed air through the supply line denoted 14, and on the other, to one of the inputs of three AND gates 34, 35 and 37; in the case of the AND gate denoted 37 the signal first passes through a digital inverter 36. The remaining input of the AND gate denoted 34 is in receipt of the signal from the photoelectric cell denoted 15—15', and its output is directed into the second input of the OR gate 32, whilst the remaining input of the AND denoted 37 receives the signal from the photoelectric cell denoted 11—11'.

38 denotes a NAND gate the inputs of which are in receipt of the signals from the four photoreflective cells 16, 17, 18 and 19; the output of this NAND 38 is connected to one input of an AND gate 39 the remaining input of which receives the signal from the photoelectric cell denoted 11—11', routed thereinto by way of a digital inverter 40. The signal from this same AND gate 39 is fed into the remaining input of the AND denoted 35 the output from which is connected to the third input of the OR gate 32.

The output signal from the OR gate 32 is cascaded into a memory circuit 43, e.g. a flip-flop, the output of which is fed into one input of a final AND gate 44; the remaining input of this same AND gate 44 is in receipt of the output signal produced by the AND gate denoted 37.

The output signal from the final AND 44 serves to trigger an energizing circuit 25' which operates a solenoid valve controlling the flow of compressed air through the supply line denoted 25, and when emitted, also resets the memory 43.

In addition to connecting with the AND gate denoted 39, the output from the digital inverter 40 is also routed to the remaining input of the AND gate denoted 45, and to a timer 50; the output signal from the timer serves to reset the memory denoted 42.

Operation of the quality control device will now be described.

Prior to arrival of a pack 4 of cigarettes at the area occupied by the transducers 10, the outputs from the transducers will be level-0: this produces a level-1 output signal from the NAND gate 30, which in conjunction with level-0 from the initial beam 11-11' signifies that AND 31 remains inhibited.

Figure 6A:
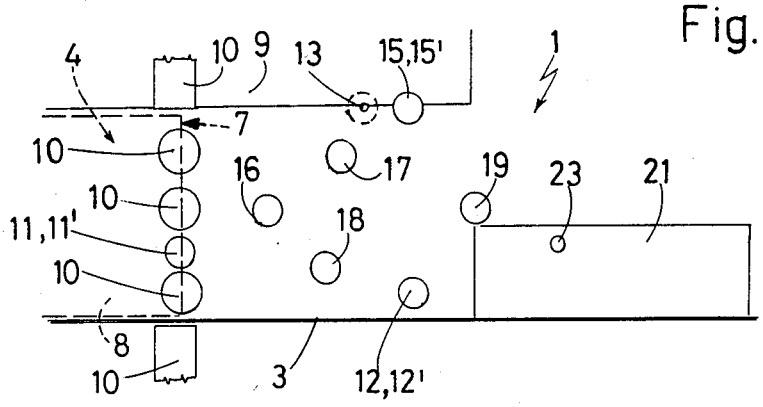
FIGS. 6*a*...*f* show the succession of operating steps effected by a device according to the invention, at different stages of the packet's progress through the quality control area.

Similarly, the OR gate 32 remains inhibited as a result of the level-0 output signal relayed to its second and third inputs through AND gates 35 and 34 from the as-yet unbroken beam denoted 12-12' The leading edge 7 of the packet 4 breaks the beam at 11-11' (see FIG. 6*a*), enabling the AND gate 31, and from this point onward for the entire duration of the packet's progess through the device, given that the foil wrapping is free from defects and its proximity thus keeps all the transducers 10 excited, the NAND gate 30 will continue to receive all inputs at level-1, and to produce a level-0 output signal. In the event of the foil wrapping being defective or incomplete, on the other hand, or folded incorrectly over the top 7 of the packet, then at least one of the transducers will emit at level-0 and the output from the NAND gate 30 will revert to level-1, giving a level-1 output signal from the AND gate 31 and the relative memory 42. The next AND gate 45 remains inhibited at this juncture by the signal from the digital inverter 40.

Figure 6B:
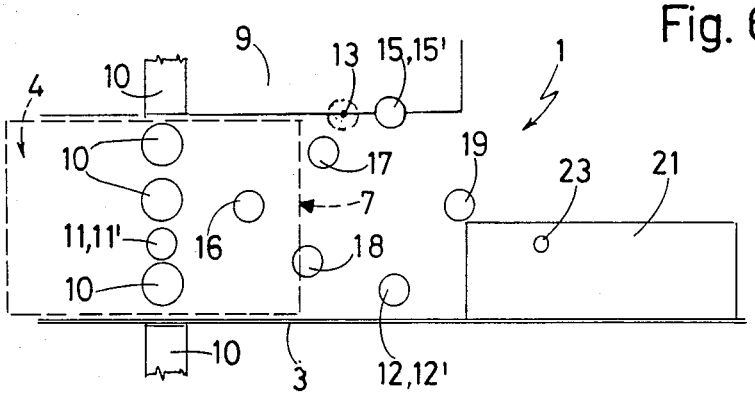

The packet 4 proceeds forward, reflecting the label detection beams back to their respective receivers 16, 17 and 18 (see FIG. 6*b*); no output signal will be forthcoming from the relative AND gate 39 as yet, inhibited as it is by the level-1 signal from the initial beam 11-11'.

Figure 6C:
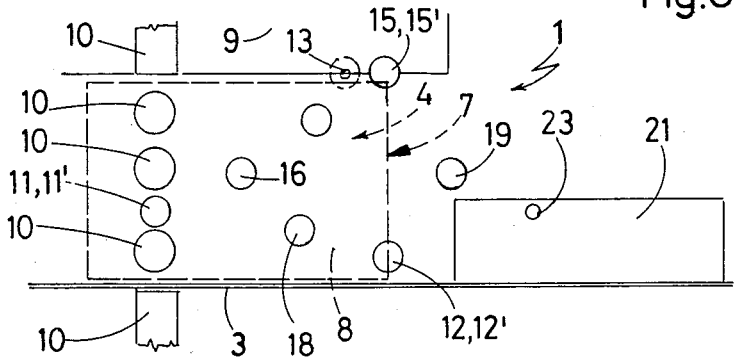

Next, the leading edge 7 of the packet 4 breaks the beam at 12-12' (see FIG. 6*c*), producing a level-1 signal which triggers the energizing circuit 14' such that a blast of compressed air is jetted at the upwardly-directed longitudinal side face 6 of the packet 4, the effect of which will be to lift an imperfectly-stuck fold 6' clear of the rest of the wrapping. Should this particular defect occur, the top beam 15-15' will be broken, and an error signal generated through the OR gate 32, thus shifting the output of the memory 43 to level-1.

The level-1 signal emitted by the photoelectric cell denoted 12-12' also has the effect of inhibiting the final AND gate 44.

It will also be observed that the output signal from the AND gate denoted 34 will remain at level-1 for the duration of the packet's passage between the emitters and receivers denoted 12, 15 and 12', 15'.

Figure 6D:
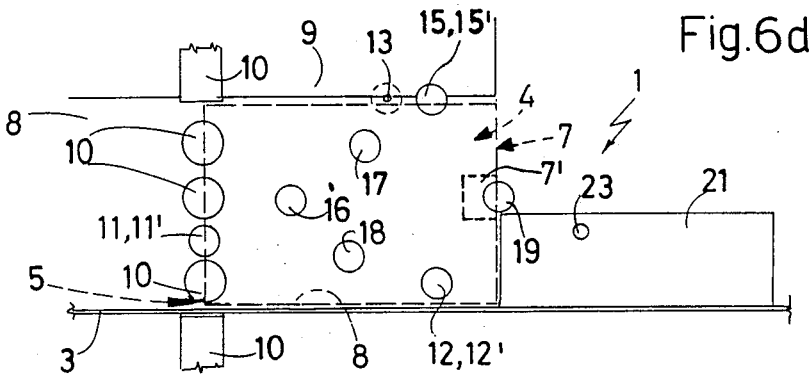

Carried forward by the conveyor belt 3, the bottom, i.e. the trailing end 5 of the packet 4, ultimately clears the initial beam 11-11' (FIG. 6*d*) and the level-0 signal thus generated enables the AND gate denoted 39. At this point, the packet 4 will be positioned with its salient label features and the government seal 7' positioned exactly along+ side the respective receivers 16, 17, 18 and 19; accordingly, a correctly labelled and sealed packet will cause all four receivers to emit a level-1 signal, giving level-0 at the outputs of the NAND gate 38 and the following AND gate 39. In the event of at least one error being detected via 16, 17, 18 or 19, on the other hand, then the relative receiver will continue to emit level-0 and the two gates 38 and 39 will stay at level-1, likewise the next AND gate 35 in line, which is now enabled; the result is that the output from the memory 43 will also shift to level-1 (if not already set), and one has logical evidence of a sealing or labelling defect, meaning that the packet 4 must be rejected.

With the packet 4 clear of the first photoelectric cell 11-11', restoration of the beam also has the effect of inhibiting the AND denoted 31, and enabling that denoted 45 such that any error signal currently forthcoming from the relative memory 42 can be relayed forward to the memory 43 downstream, whereupon the first memory 42 will be reset by the timer 50 following the prescribed delay.

Figure 6E:
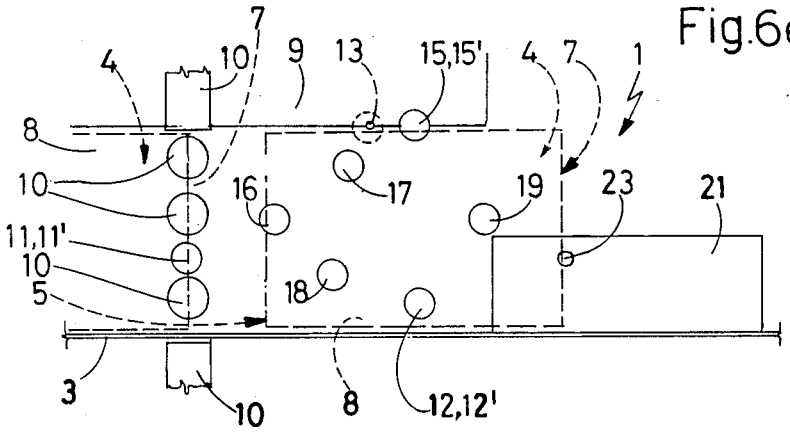

In the event of the bottom fold 5' of the wrapping not being firmly stuck down, the beam at 11-11' will remain broken, signifying retention of the relative level-1 signal; the result is that, with all the transducers 10 returned to level-0, the signal gated at AND 31 will be level-1, and a reject instruction is thus transmitted to the memory 42. As the fully checked packet 4 proceeds forward, the leading edge of the next pack in line breaks the beam of the first photoelectric cell 11-11' (FIG. 6*e*) and one has commencement of a fresh cycle identical to that just completed.

Any error in positioning of the inner foil wrapping is picked up by the ring of transducers 10 and registered by emission of a level-1 signal from the NAND gate 30 and from the successive AND gate 31, which is now enabled once more by the level-1 signal from the first photoelectric cell 11-11'. In this state, the memory denoted 42 can be operated by the output from the AND gate 31, though inhibition of the next AND 45 prevents any reject instruction from being transferred too early to the downstream memory 43. The final AND gate 44 remains inhibited as a result of the level-0 condition of the inverter denoted 36 and relative AND gate 37.

Figure 6F:
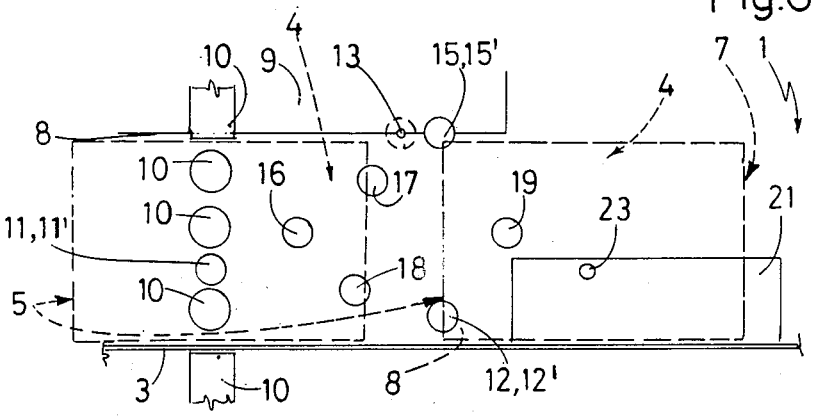

As the trailing end 5 of the first pack 4 reaches the photoelectric cell denoted 12-12' (see FIG. 6*f*), a level-0 signal is triggered; as a result, the energizing circuit 14' and the AND gate 34 are inhibited, whilst the AND gate denoted 37 is enabled and likewise the final AND gate 44. Should the downstream memory 43 happen to have been set (signifying that the pack is sub-standard and must be rejected), the circuit denoted 25' will now be triggered, the solenoid valve energized, and compressed air flows through the knock-out line 24; the packet 4 is invested full face by the jet, and is duly ejected by way of the opening in the opposite fence 22.

A level-1 output signal from the same gate 44 also resets the downstream memory 43, so that, with the packet 4 next in line arriving at the photoelectric cell denoted 12-12' (as in FIG. 6*c*), the identical sequence of control operations can be implemented.

The advantages afforded by the device thus described are self-evident. One has a comprehensive quality control check run on each single packet 4, with the correct position of the wrapping material (including the inner sheet of tin foil) and firm adhesion of the gummed side folds being verified in one operation; what is more, the device provides automatically for ejection of any packet found to be defective.

Neither maximum nor minimum limitations are implied by the description of the device as provided above; an embodiment not incorporating, say, the pneumatic test facility and its energizing circuit 14', or the photoelectric components denoted 16, 17, 18 and 19 and relative circuitry, would nonetheless be such as to fall within the bounds of protection afforded by claims hereunder.

What is claimed:

1. A quality control device for detection of the correct shape of packets made of wrapping materials wrapped about a product, comprising:

means that check for at least one of the prepsence and correct position of at least one of the wrapping materials from which the packets are fashioned;

conveyor means which carry the packets through a longitudinal path in single file in such a way as to pass through said means that check for at least one of the presence and correct position of at least one of the wrapping materials from which the packets are fashioned; and control circuitry, which, upon receipt thereby of an error detection signal supplied by the means that check for at least one of the presence and correct position of the wrapping materials, serves to trigger the operation of means by which defective packets are ejected;

said means that check for at least one of the presence and correct position of the wrapping materials comprising first means designed to detect the proximity of a wrapping fashioned in conductive material;

said conveyor means being arranged to carry said packets in single file through a tunnel;

said first means including a plurality of transducers locates so as to encircle the tunnel through which the packets are conveyed in single file and said transducers being wired such that an error detection signal can be emitted as long as the transducers remain activated, and will be gated whenever at least one said transducer fails to produce a signal in response proximity of the conductive material.

2. The quality control device as in claim 1, wherein:

the transducers are arranged to detect any part of the wrapping materials that do not entirely envelop the product.

3. The quality control device as in claim 1, wherein:

said means that check for at least one of the presence and correct position of the wrapping materials further comprise second means for detecting any defect in application of an uppermost longitudinal fold in the wrapping materials, and to supply an error signal to the control circuitry.

4. The quality control device as in claim 3, wherein:

said second means include at least one photoelectric cell positioned so as to be in alignment, during use, with folds of the wrapping materials that cover upwardly directed side faces of the packets.

5. The quality control device as in claim 3, wherein:

said second means comprise means for supplying a jet of air that will penetrate under and lift any longitudinal fold in the wrapping materials that has not been properly stuck down.

6. The quality control device as in claim 3, wherein:

operation of at least one of said first means and said second means is enabled by respective means that are excited by proximity of a packet to points where at least one of said first and second means are installed.

7. The quality control device as in claim 6, wherein:

said means excited by proximity of a packet include photoelectric cells.

8. The quality control device as in claim 1, wherein:

said means that check for at least one of the presence and correct position of the wrapping materials comprise third means for detecting graphic features occupying a given area on the wrapping materials, and to supply an error signal to said control circuit upon detection of a deviation from an expected detection from such area in respect to a respective packet.

9. The quality control device as in claim 8, wherein:

said third means include a plurality of photoelectric cells, the operation of which is enabled by way of a respective control medium for emitting a signal upon arrival of a packet at a given position.

10. The quality control device as in claim 1, for use with packets having top and bottom ends, wherein:

the transducer are arranged to detect any part of the wrapping materials that are not stably folded down at the top and bottom ends of the packets.

11. The quality control device as in claim 1, further including:

means for ejecting packets sensed, by said means that check for at least one of the presence and correct position of at least one of the wrapping materials from which the packets are fashioned, to be defectively wrapped;

said conveyor means being juxtaposed with said means for ejecting packets sensed to be defectively wrapped, such that said packets are serially conveyed into proximity with said means for ejecting packets sensed to be defectively wrapped; and said control circuitry includes control means for emitting a signal to said means for ejecting packets sensed to be defectively wrapped each time that said conveyor means has conveyed into proximity with said means for ejecting packets a packet sensed to be defectively wrapped.

12. The quality control device as in claim 11, wherein:

said control means includes a memory device having an input stage arranged to receive said error detection signal.

13. The quality control device of claim 11, wherein:

said means for ejecting packets is arranged to impinge on each packets sensed to be defectively wrapped by contacting one side thereof, and thereafter displace each such packet sideways from said conveyor means and into a reject collection area.

14. The quality control device as in claim 1, wherein:

said first means is constructed to detect the proximity of a wrapping made of metal foil.

15. A quality control device for detection of the correct shape of a packets made of wrapping materials wrapped about a product, comprising:

means that check for at least one of the presence and correct position of at least one of the wrapping materials from which the packets are fashioned;

conveyor means which carry the packets through a longitudinal path in single file in such a way as to pass through said means that check for at least one of the presence and correct position of at least one of the wrapping materials from which the packets are fashioned; and control circuitry, which, upon receipt thereby of an error detection signal supplied by the means that check for at least one of the presence and correct position of the wrapping materials, serves to trigger the operation of means by which defective packets are ejected;

said means that check for at least one of the presence and correct position of the wrapping materials comprising first means designed to detect the proximity of a wrapping fashioned in conductive material;

said means that check for at least one of the presence and correct position of the wrapping materials further comprising second means for detecting any defect in application of an uppermost longitudinal fold in the wrapping materials, and for supplying an error signal to the control circuitry;

operation of at least one of said first means and said second means being enabled by respective means that are excited by proximity of a packet to points where at least one of said first and second means are installed;

said means excited by proximity of a packet including photoelectric cells;

said conveyor means being arranged to carry said packets in single file through a tunnel;

said first means including a plurality of transducers located so as to encircle the tunnel through which the packets are conveyed in single file, and said transducers being wired such that an error detection signal can be emitted as long as the transducers remain activated, and will be gated whenever at least one said transducer fails to produce a signal in response to proximity of the conductive material;

said means that check for at least one of the presence and correct position of the wrapping materials comprising third means for detecting graphic features occupying a given area on the wrapping materials, and to supply an error signal to said control circuit upon detection of a deviation from an expected detection from such area in respect to a respective packet;

said third means including a plurality of photoelectric cells the operation of which is enabled by way of a respective control medium for emitting a signal upon arrival of a packet at a given position; and said means that are excited by proximity of a packet to points at which at least one of said first and second means being installed also serve as said respective control medium for emitting a signal upon arrival of a packet at a given position.

* * * * *